US005930854A

United States Patent [19]

O'Neill et al.

[11] Patent Number: 5,930,854

[45] Date of Patent: Aug. 3, 1999

[54] INFANT ACCOMMODATION APPARATUS

[75] Inventors: Catherine O'Neill, London; Diane Hall, Hadfield via Hyde, both of United Kingdom

[73] Assignee: James Galt & Company Limited, Cheshire, United Kingdom

[21] Appl. No.: 08/948,974

[22] Filed: Oct. 10, 1997

[30] Foreign Application Priority Data

Oct. 10, 1996 [GB] United Kingdom ..... 9621110

[51] Int. Cl.[6] ..... A47D 13/00

[52] U.S. Cl. ..... 5/655; 5/97; 5/416; 135/96; 135/135; 135/158; 446/227

[58] Field of Search ..... 5/655, 97, 416, 5/414, 418; 135/96, 124, 135, 158, 159, 138; 446/227

[56] References Cited

U.S. PATENT DOCUMENTS

| | | | |
|---|---|---|---|
| 1,748,932 | 2/1930 | Medart et al. | 135/96 |
| 2,498,203 | 2/1950 | Fischer | 5/97 |
| 3,493,228 | 2/1970 | Hicks et al. | 5/655 |
| 4,359,266 | 11/1982 | Rohlf et al. | 350/307 |
| 4,750,509 | 6/1988 | Kim | 135/138 |
| 4,852,598 | 8/1989 | Griesenbeck | 5/414 |
| 4,884,306 | 12/1989 | Goetz | 5/503 |
| 4,945,584 | 8/1990 | LaMantia | 5/97 |
| 5,187,826 | 2/1993 | Mariol | 5/655 |
| 5,341,530 | 8/1994 | Ward | 5/655 |
| 5,642,750 | 7/1997 | Brown et al. | 135/124 |
| 5,813,066 | 9/1998 | Gebhard et al. | 5/655 |

FOREIGN PATENT DOCUMENTS

| | | | |
|---|---|---|---|
| 40 24 807 | 2/1992 | Germany | 5/655 |
| 1322225 | 7/1973 | United Kingdom | 5/99.1 |
| 2175802 | 12/1986 | United Kingdom . | |
| 2249331 | 5/1992 | United Kingdom | 135/138 |

*Primary Examiner*—Alexander Grosz

*Attorney, Agent, or Firm*—Nikaido Marmelstein Murray & Oram LLP

[57] ABSTRACT

Infant accommodation apparatus 2 comprises an annular inflatable support device 4 and, releasably secured thereto, a framework 6 which extends over the device 4 and includes toys arranged to stimulate an infant accommodated within an accommodation region 7 of the device.

25 Claims, 4 Drawing Sheets

INFANT ACCOMMODATION APPARATUS

BACKGROUND OF THE INVENTION

1. Field of the Invention

This invention relates to infant accommodation apparatus.

2. Related Art

Numerous types of apparatus for accommodating and/or entertaining infants are known. For example, playpens comprise an enclosure wall supported on the floor within which an infant is placed. Another known apparatus comprises a pair of soft foam semi-circles secured together in order to define a circular area for accommodating an infant. A further known apparatus described in U.K. Patent Application GB 93 24923.3 comprises an inflatable annular body within which an infant can be accommodated.

Problems associated with known apparatus include relatively short useful life time and/or limited stimulation, in particular visual stimulation for an infant. For example, playpens are not generally used for young infants that cannot safely sit up and support themselves and, furthermore, provide little more than an unaesthetic "cage" around the infant; the soft foam semi-circles are also generally not used for young infants and provide little more than a padded enclosure for an infant; and the inflatable annular body described provides little visual stimulation for an infant seated within the confines of the annular body.

It is an object of the present invention to address problems associated with known infant accommodation apparatus.

SUMMARY OF THE INVENTION

According to a first aspect of the invention, there is provided infant accommodation apparatus comprising:

- a support device which includes an upstanding enclosure wall which surrounds an infant accommodation region in which an infant may be positioned in use; and
- a frame means extending above the support device for visually stimulating an infant positioned in the infant accommodation region.

Said upstanding enclosure wall of said support device is preferably resilient and/or cushioning and/or deformable. Said wall may be defined by a foam member, but preferably is defined by means of an inflated member which inflated member can preferably be deflated.

Said support device preferably includes an outer surface provided in a multiplicity of colours. Tactile sense stimulation means and/or auditory sense stimulation means may be associated with said surface.

Said support device may be of any suitable shape. For example, said support device may be arranged not to fully enclose the region for accommodating an infant, in which case, the support device may be arranged to define a "C"-shape or a "U"-shape. Preferably, however, said support device is arranged to define an endless enclosure wall around the region for accommodating an infant. In this event, said support device may be polygonal, for example square, rectangular, hexagonal or octagonal, or circular or oval-shaped in cross-section. Said support device is preferably arranged to be of substantially constant cross-section along its extent. It is preferably circular in cross-section.

The support device may be arranged to define a first condition. In said first condition, said support device may have a first volume. In this case, said support device is preferably relatively rigid. Preferably, also, said support device is cushioning and/or deformable when in said first condition. The device may be arranged to define a second condition. In said second condition, said support device may have a second volume. Said second volume is preferably less than said first volume. Said second volume suitably represents the minimum volume of said support device. Said second condition of the device suitably represents a storage condition of the device. The device may be arranged to define a third condition. In said third condition, said support device may have a third volume. Said third volume is preferably greater than said second volume and/or less than said first volume. When in said third condition, said support device is suitably less rigid than when the device is in said first condition. Also, said support device is preferably cushioning and/or deformable.

When the device is in said first condition, it may be inflated to 80%–100% of its maximum volume. When the device is in said second condition, it is preferably substantially deflated. When in said third condition, it may be inflated to 40%–79.99% of its maximum volume.

Said support means preferably incorporates a cover means which is preferably removable from an insert member of the device. Said insert member preferably provides the resilient and/or cushioning and/or deformable properties of the support device. Said insert member is preferably said inflated member.

Said cover means is preferably arranged to cover substantially the whole of said insert member. Said cover means is preferably flexible. Said cover means is preferably non-self-supporting. The cover means is preferably made out of a fabric which is preferably washable.

Said cover means preferably has an internal region in which the insert member is accommodated. A cover opening is suitably provided in said cover means for allowing access to said internal region. Closure means, for example in the form of a zip fastener, may be provided for closing said cover opening.

Said support device preferably includes first securement means for securing said frame means in position. Said first securement means preferably is arranged on an outwardly, preferably generally radially outwardly, facing surface of the support device. Said support means is preferably spaced from a base of said support means (which base is arranged to abut the ground in use), suitably by a distance which is greater than one-quarter, preferably greater than one third, of the height of the support device. Preferably, said support means is arranged approximately halfway between the base and a top of the support device.

Said first securement means preferably defines a female element for receiving a male portion of said frame means. Said first securement means preferably comprises a loop. Said loop is preferably an integral part of said cover means when provided.

Said support device preferably includes a plurality of first securement means. At least three, preferably four, first securement means may be provided. The or each first securement means is preferably provided on the periphery of the support device.

The top of said frame means may extend above the support device to a position which is spaced from said support device by a distance which is greater preferably by a factor of at least two, more preferably at least three, than the height of said support device.

Said frame means preferably includes at least two, more preferably at least three, limbs extending upwardly from said support device. In an especially preferred embodiment, four limbs are provided. Each of said limbs is preferably curved and preferably extends to an apex region of the frame means which apex region is preferably positioned substantially centrally above the support device. The or each limb preferably abuts a region, preferably a curved region, of the support device and is suitably positioned outside the periphery of the support device. By arranging the limb(s) against a curved region, the frame means may be stabilized and held relatively rigidly against the support device.

Said limbs of said frame means preferably include plastics members. Said limbs are preferably resilient. Said limbs, for example said plastic members when provided, are preferably provided with a cover means.

Said frame means preferably includes means for securing, preferably releasably securing, stimulation means, suitably in the form of toys. One of said stimulation means is preferably a mirror. Said means for securing may comprise male or female elements arrangements to cooperate with the other one of a male or female element associated with said stimulation means. Preferably, said male or female element is associated with said cover means of the frame means.

The invention extends to a method of assembling an infant accommodation apparatus which comprises providing a frame means above a support device which includes an upstanding enclosure wall which surrounds an infant accommodation region in which an infant may be positioned in use.

The method may include adjusting the volume of the support device.

The invention extends to a kit for assembly of an accommodation apparatus according to the first aspect or for use in the method described, the kit comprising means for defining a frame means and means for defining a support device.

Any feature of any aspect of any invention or embodiment described herein may be combined with any feature of any aspect of any other invention or embodiment described herein.

Specific embodiments of the invention will now be described, by way of example, with reference to the accompanying diagrammatic drawings, in which:

DESCRIPTION OF THE PREFERRED EMBODIMENTS

Figure 1:
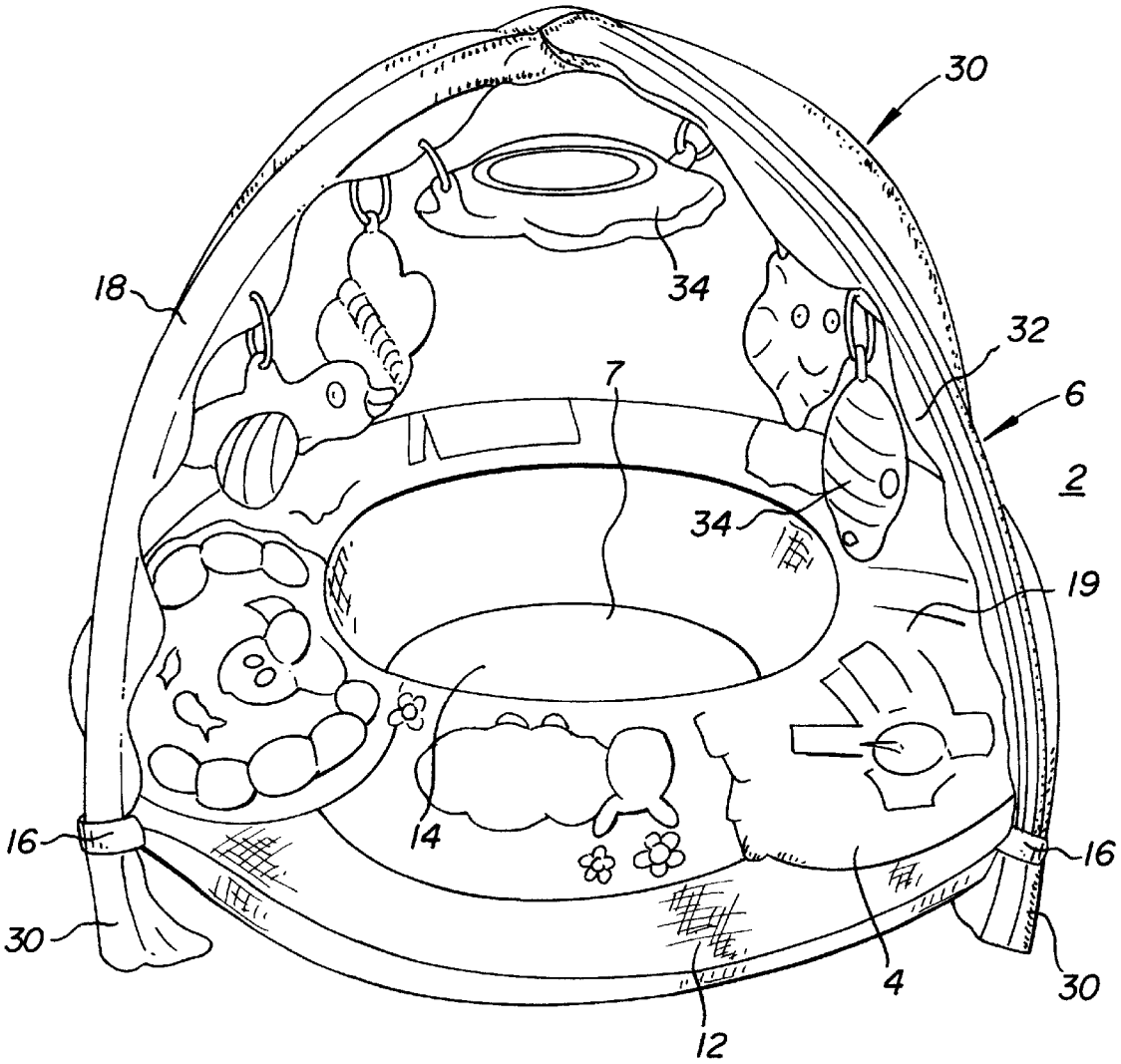
FIG. 1 is a front view of an infant accommodation apparatus.
Figure 2:
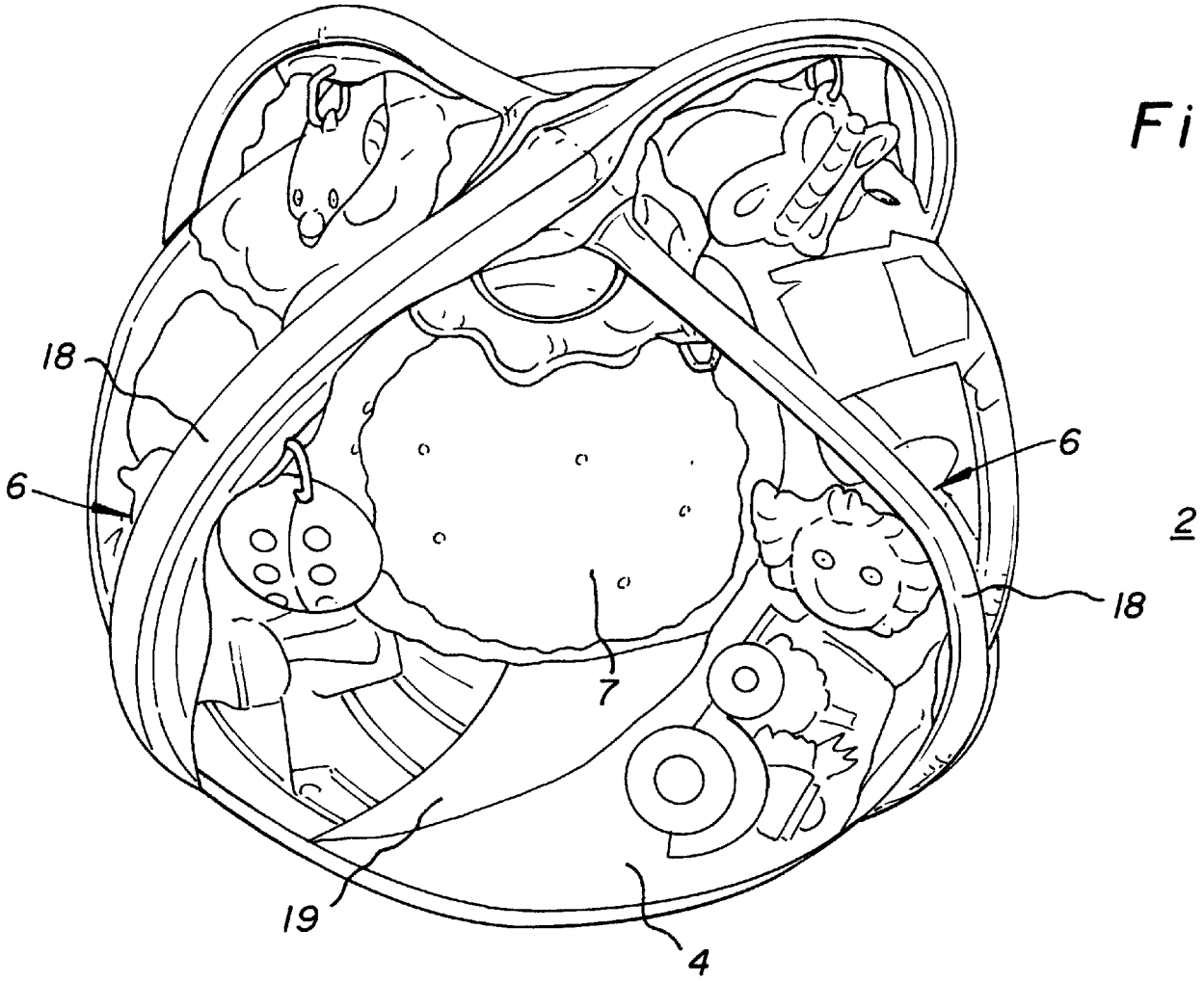
FIG. 2 is a top view of the infant accommodation apparatus.
Figure 3:
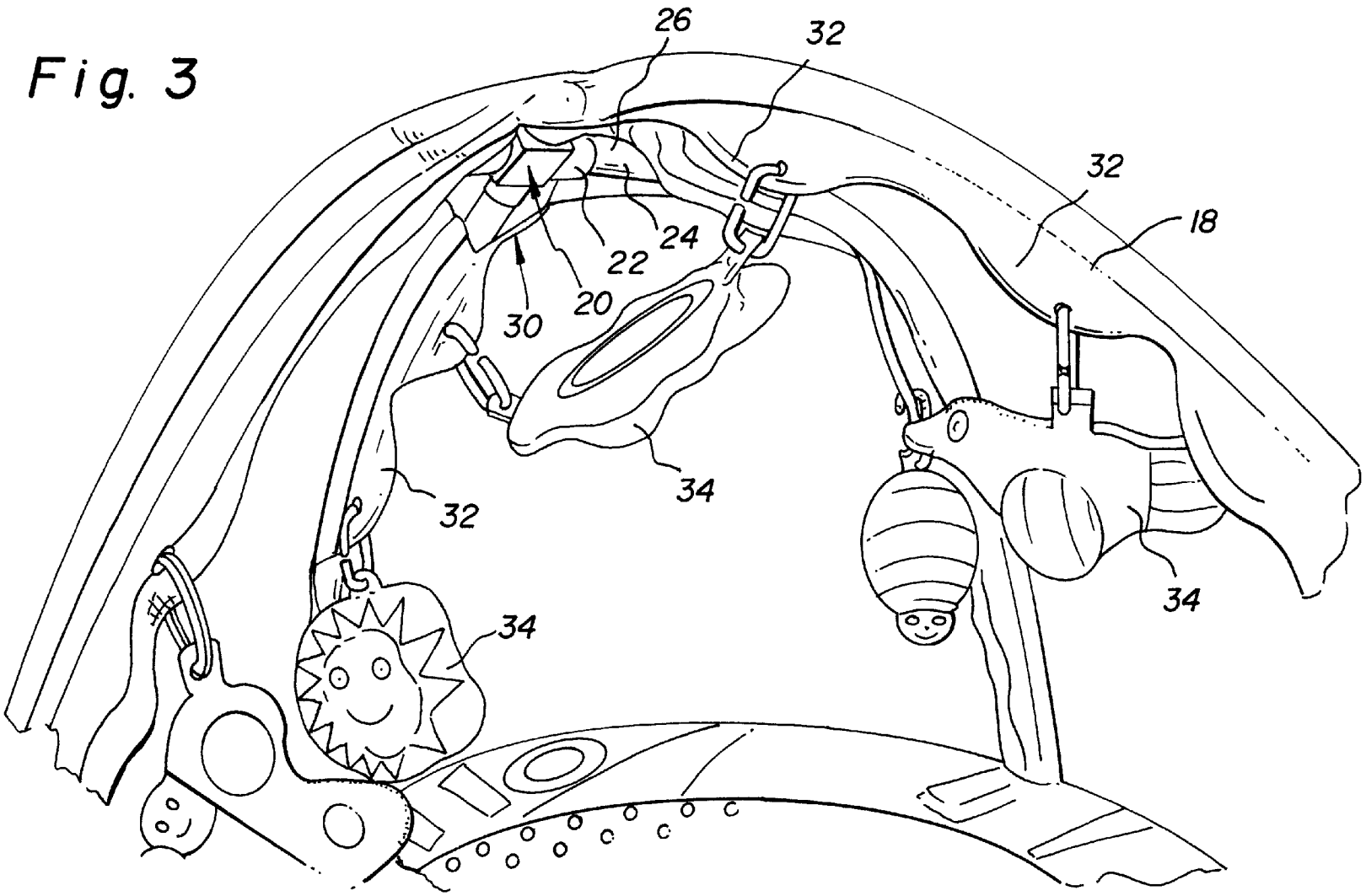
FIG. 3 is a side view of part of the apparatus with a part of a framework of the apparatus exposed.
Figure 4:
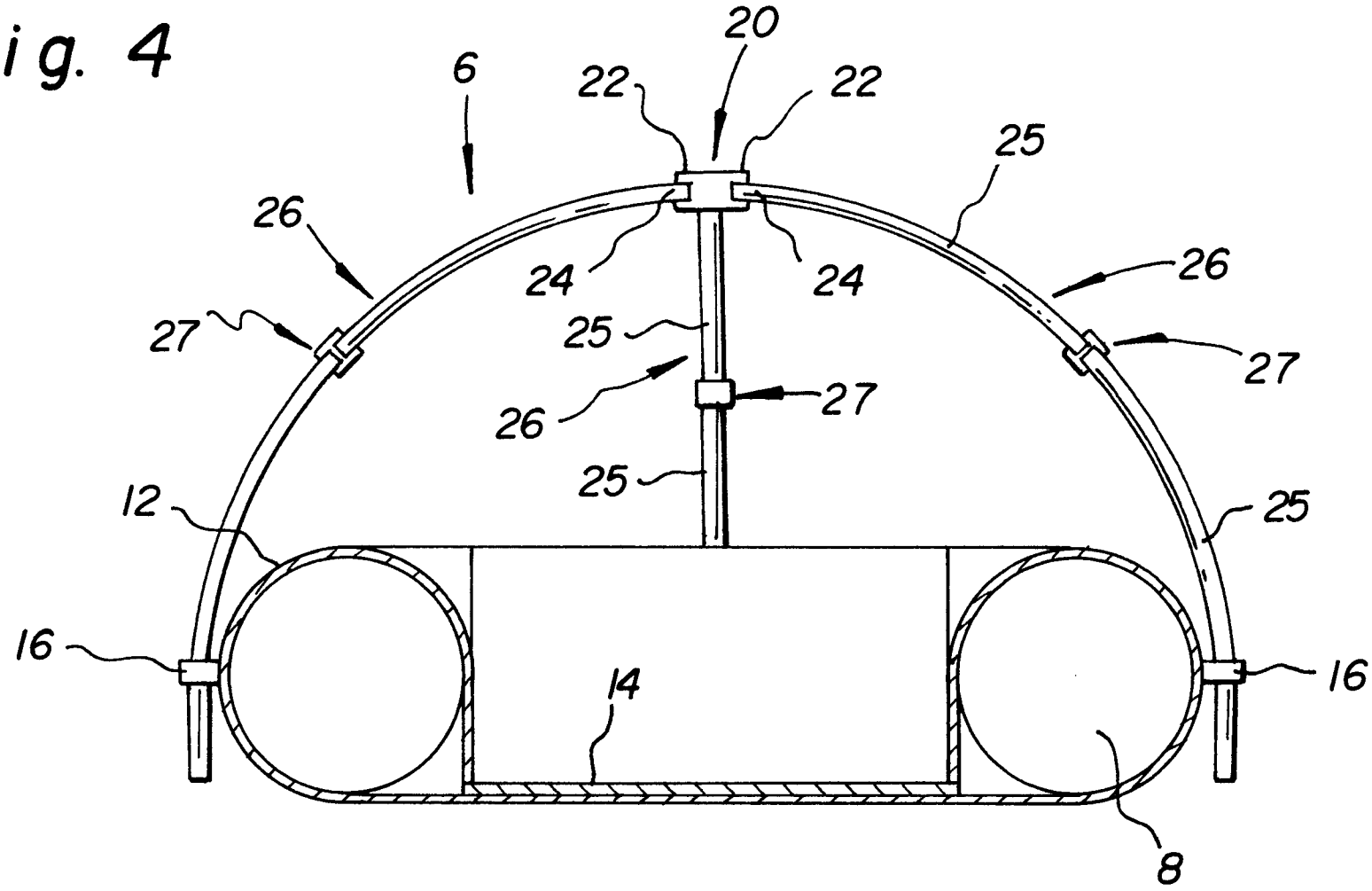
FIG. 4 is a vertical cross-section through the apparatus with a fabric cover of the framework omitted in the interests of clarity.

The infant accommodation apparatus 2 comprises an annular inflatable support device 4 and, releasably secured thereto, a framework 6 which extends over the device 4 and includes toys arranged to stimulate, in particular to visually stimulate, an infant accommodated within an accommodation region 7 of the device.

The apparatus 2 is described in greater detail below.

The support device 4 comprises an inner inflatable plastic ring 8 and an outer removable fabric cover 12 which is arranged to completely enclose the ring 8. The ring incorporates a padded base part 14 upon which the infant may lie, kneel or sit when in the accommodation region 7.

Four elastic loops 16 are incorporated into the fabric cover and spaced at 90° intervals around the periphery of the cover at a level which is approximately midway between the upper and lower walls of the device 4. The loops are arranged to resiliently engage members 18 of the framework 6.

Generally upwardly facing outer surface 19 of the cover is highly decorated and provided with various means for stimulating the senses of an infant. For example, the cover may be visually stimulating by incorporating representations in bright and contrasting colours, it may stimulate the tactile sense by incorporating materials of different textures; and it may stimulate the auditory sense by incorporating means for causing squeaks or crinkle sounds or electronic devices for playing melodies or making other noises.

Framework 6 is arranged to provide a dome-shaped structure over the device 4 and comprises a cruciform connector 20 which includes outwardly facing ports 22 which are spaced at 90° to one another and are arranged to slidably receive ends 24 of arcuate tubular struts 26. Each strut 26 has two strut parts 25 connected by a female connector 27. The framework 6 is provided with a one piece removable fabric cover 30 which encloses each strut 26 and connector 20. The cover comprises a first sleeve which is arranged to cover one pair of diametrically extending struts 26 and two other sleeves extending perpendicular to the first sleeve and stitched thereto for covering the other two struts. Access to the cover is obtained via an opening facing downwardly in use in the region of the cover which accommodates the cruciform connector.

The framework 6 is assembled by inserting each strut in position in the sleeves of the cover and then inserting connector 20 into the cover via the downwardly facing opening described and securing the struts to the connector.

The cover 30 is brightly colored and it includes scalloped areas 32 which incorporate buttonholes to which toys 34 can be releasably secured.

Framework 6 with cover 30 in position can be releasably secured to the support device 4 by pushing the fabric covered struts 26 through loops 16 until the struts are adjacent the floor on which the apparatus is supported. The struts and, therefore, the framework 6, is retained in position by virtue of the friction between the fabric of the framework and loops 16 and the force exerted by the resilient loops.

The apparatus described can advantageously be used in a number of ways.

Firstly, the apparatus comprising device 4 and framework 6 secured to one another may be used for accommodating young infants in the age region 0–8 months wherein such infants cannot sit up unsupported or should not sit up at all. In this case, the ring 8 may be inflated to 60–70% of its full inflation in order to define a flaccid structure so that the infant can lie diametrically across the device. When the infant is so disposed, he/she is kept entertained and stimulated by the array of colours, shapes and/or devices 34 carried by the framework 6.

Secondly, as the infant grows and is able to sit up, albeit supported, he/she may be placed within accommodation region 7. In this case, the infant enters an environment which is found to highly stimulate various senses of the infant. For example, the infant can see and contact the decorated surface of the support device 4. Furthermore, the provision of the framework 6 encourages the infant to look around and up and down, and to reach out and explore, thereby developing both its senses and its motor skills—for example hand/eye coordination and manipulative skills. Importantly, however, the infant is prevented from falling back by the support provided by the walls of the device 4.

Thirdly, as the infant becomes older still, the framework 6 may be removed leaving the device 4 to act as a cosy play environment for the infant.

The apparatus 2 can be dismantled for transportation or storage. In dismantled form it may comprise a deflated ring 8, a fabric cover 12, eight disengaged strut parts 25, a cruciform connector 20, four female connectors 27, a fabric cover 30 and any toys 34.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

We claim:

1. An infant accommodation apparatus comprising:

(a) a support device including an upstanding enclosure wall defining an infant accommodation region for accommodating an infant, said support device comprising:

(1) an inflatable insert member defining said infant accommodation region, and (2) a cover within which said insert member is arranged, said cover removable from said insert means; and (b) a frame means extending above said support device and releasably secured to said cover, said frame means including stimulation means for visually stimulating an infant positioned in the infant accommodation region, said stimulation means being at least one of a toy and a mirror.

2. Apparatus according to claim 1, wherein said upstanding enclosure wall is at least one of resilient, cushioning and deformable.

3. Apparatus according to claim 1, wherein said support device is arranged to define an endless enclosure wall surrounding said infant accommodation region, said endless enclosure wall being circular in cross-section.

4. Apparatus according to claim 1, wherein said support device is arranged to define first and second conditions in which said device has different volumes.

5. Apparatus according to claim 1, wherein said cover includes first securement means for securing said frame means in position.

6. Apparatus according to claim 1, wherein said cover includes first securement means for securing said frame means in position which first securement means is arranged on an outwardly facing surface of the cover.

7. Apparatus according to claim 1, wherein said cover includes first securement means for securing said frame means in position, which first securement means is spaced from a base of said support means, which base is arranged to abut the ground in use, by a distance which is greater than one-quarter of the height of the support device.

8. Apparatus according to claim 1, wherein said cover includes first securement means for securing said frame means in position which first securement moans is arranged approximately halfway between the base and a top of the support device.

9. Apparatus according to claim 1, wherein said cover includes first securement means for securing said frame means in position which first securement means defines a female element for receiving a male portion of said frame means.

10. Apparatus according to claim 1, wherein said cover includes first securement means for securing said frame means in position which first securement means comprises a loop.

11. Apparatus according to claim 1, wherein said cover includes a plurality of first securement means for securing the frame means in position.

12. Apparatus according to claim 1, wherein said cover includes at least three securement means for securing the frame means in position.

13. Apparatus according to claim 1, wherein said cover includes first securement means for securing said frame means in position which first securement means is provided around the periphery of the cover.

14. Apparatus according to claim 1, wherein a top of said frame means extends above the support device to a position which is spaced from said support device by a distance which is greater by a factor of at least 2 than the height of said support device.

15. Apparatus according to claim 1, wherein said frame means includes at least two limbs extending upwardly from said support device.

16. Apparatus according to claim 1, wherein said frame means includes four limbs extending upwardly from said support device.

17. Apparatus according to claim 1, wherein said frame means includes at least two limbs extending upwardly from said support device wherein each of said limbs is curved and extends to an apex region of the frame means which apex region is positioned substantially centrally above the support device.

18. Apparatus according to claim 1, wherein said frame means includes at least two limbs extending upwardly from said support device wherein the or each limb abuts a region of the support device which is positioned on the outer periphery of the support device.

19. Apparatus according to claim 1, wherein said frame means includes at least two limbs extending upwardly from said support device wherein said limbs are provided with a cover.

20. A method of assembling an infant accommodation apparatus according to claim 1, which comprises releasably securing said frame means to said cover of said support device and releasably securing said stimulation means to said frame means.

21. A kit for assembly of an accommodation apparatus according to claim 1, the kit comprising:

an inflatable insert member;

a cover for receiving said insert member and accommodating it in an inflated condition;

a frame means which is releasably securable to the cover;

stimulation means selected from a toy and a mirror;

means for releasably securing said stimulation means to said frame means.

22. A kit according to claim 21, wherein said kit further includes a fabric cover for covering said frame means and wherein:

said cover for receiving said insert member includes at least three loops for receiving respective male portions of said frame means;

said frame means includes at least three limbs for engaging said three loops;

means is provided for securing respective ends of said three limbs together.

23. Apparatus according to claim 1, wherein said cover includes at least three loops for receiving respective male portions of said frame means, wherein said male portions are components of respective curved limbs of said frame means, wherein said limbs extend to an apex region of the frame means at which region said limbs are secured together, said apex region being positioned substantially centrally above the support device.

24. Apparatus according to claim 23, wherein said limbs are provided with a removable fabric cover which cover includes means for securing said stimulation means in position.

25. Apparatus according to claim 23, wherein each of said respective curved limbs of said frame means comprises two strut parts connected together, one of which strut parts extends to said apex region and one of which strut parts includes said male portion which is engaged with a loop.

* * * * *